US011083318B2

(12) United States Patent
Weller

(10) Patent No.: US 11,083,318 B2
(45) Date of Patent: Aug. 10, 2021

(54) AUTOMATICALLY LOCKING DELIVERY BOX

(71) Applicant: Ronald Weller, Hamilton, IN (US)

(72) Inventor: Ronald Weller, Hamilton, IN (US)

( * ) Notice: Subject to any disclaimer, the term of this patent is extended or adjusted under 35 U.S.C. 154(b) by 0 days.

(21) Appl. No.: 17/039,367

(22) Filed: Sep. 30, 2020

(65) Prior Publication Data

US 2021/0093117 A1 Apr. 1, 2021

Related U.S. Application Data

(60) Provisional application No. 62/908,192, filed on Sep. 30, 2019.

(51) Int. Cl.
*A47G 29/14* (2006.01)
*A47G 29/30* (2006.01)

(52) U.S. Cl.
CPC ..... *A47G 29/141* (2013.01); *A47G 29/30* (2013.01)

(58) Field of Classification Search
CPC .. A47G 29/141; A47G 29/30; E05B 65/0075; E05B 17/22; E05B 35/12; E05B 37/0031; E05B 37/0037; E05B 47/00; G07C 9/00912
USPC ..... 232/45; 340/5.73, 568.1, 569; 70/63, 70/160, 265, 284; 200/61.63
See application file for complete search history.

(56) References Cited

U.S. PATENT DOCUMENTS

| | | | | |
|---|---|---|---|---|
| 8,358,199 | B2 * | 1/2013 | Nesling | A47G 29/30 340/5.73 |
| 10,537,196 | B1 * | 1/2020 | MacPherson | A47G 29/20 |
| 2010/0085148 | A1 * | 4/2010 | Nesling | G07C 9/00912 340/5.73 |
| 2016/0060008 | A1 * | 3/2016 | Farentinos | E05B 49/002 220/211 |
| 2019/0313826 | A1 * | 10/2019 | Bickford | B65D 15/22 |
| 2020/0397172 | A1 * | 12/2020 | Kennett | E05B 47/00 |

* cited by examiner

*Primary Examiner* — William L Miller
(74) *Attorney, Agent, or Firm* — Boudwin Intellectual Property; Daniel Boudwin

(57) ABSTRACT

An automatically locking delivery box is provided. The automatically locking delivery box has a base with a plurality of sidewalls rising therefrom, a locking system, and a lid hingedly attached to a top portion of a sidewall. The locking system can lock the lid to the sidewalls. A button is connected to the locking system such that the locking system can unlock one time when the button is actuated. The locking system detects when the lid is opened and automatically locks once the lid is closed again. The locking system also includes a keyhole for a complementary key which can be used to manually unlock the device. Once the locking system is unlocked by the button, it cannot be unlocked again until the key is used at which point the locking system is reset such that the button can be actuated, and the locking system can be unlocked one time.

9 Claims, 4 Drawing Sheets

AUTOMATICALLY LOCKING DELIVERY BOX

CROSS REFERENCE TO RELATED APPLICATIONS

This application claims the benefit of U.S. Provisional Application No. 62/908,192 filed on Sep. 30, 2019. The above identified patent application is herein incorporated by reference in its entirety to provide continuity of disclosure.

BACKGROUND OF THE INVENTION

The present invention relates to mailboxes. More particularly, the present invention provides for an automatically locking delivery box which can be unlocked a single time by pressing a button, thereby enabling a delivery person to open the device, leave a package and/or mail inside the device and close the device. As the device automatically locks once opened, the package and/or mail is secured inside automatically. The automatically locking delivery box will remain locked until a key is utilized to open the device. Once the key is utilized, the button can be used anew.

Many people get mail daily and have packages delivered to their residence. Typically, such people have mailboxes which the mail carrier or delivery person can utilize to deposit the mail and packages at the recipient's residence. Such mailboxes are typically unsecured, and anyone can open and close the mailbox at any time. Therefore, mail and packages left in such devices can easily be stolen by simply opening the box. Additionally, many packages are too large to be deposited in such a mailbox. Such packages are typically left near the door of the recipient out in the open for all to see. Theft of these packages is not an uncommon occurence as they are plainly visible and can simply be picked up and carted off by anyone. It can be difficult for recipients to prevent the theft of their packages, even with preventative measures such as surveillance devices. Even with surveillance devices, the theft of the mail and/or package is not prevented, merely documented.

Devices have been disclosed in the known art that relate to mailboxes. These include devices that have been patented and disclosed in patent application publications. However, the devices in the known art have several drawbacks. Some people desire to put locks on their mailbox to secure items inside, but this necessitates the delivery person having a key or combination to the mailbox in order to make their delivery. Some people utilize delivery drop boxes to assist in reducing theft, but such delivery drop boxes can be picked up and removed with the desired mail and/or package inside. In addition, these drop boxes are traditionally unattractive.

The present invention substantially diverges in design elements from the known art and consequently it is clear that there is a need in the art for an improvement to existing mailbox devices. In this regard the present invention substantially fulfills these needs.

SUMMARY OF THE INVENTION

In view of the foregoing disadvantages inherent in the known types of mailboxes now present in the art, the present invention provides an automatically locking delivery box which can be unlocked a single time by pressing a button, thereby enabling a delivery person to open the device, leave a package and/or mail inside the device, and close the device. As the device automatically locks once opened, the package and/or mail is secured inside automatically. The automatically locking delivery box will remain locked until a key is utilized to open the device. Once the key is utilized, the button can be used anew. The present automatically locking delivery box comprises a base with a plurality of sidewalls rising therefrom, a locking system, and a lid hingedly attached to a top portion of a sidewall. The locking system can lock the lid to the sidewalls. A button is connected to the locking system such that the locking system can unlock one time when the button is actuated. The locking system detects when the lid is opened and automatically locks once the lid is closed again. The locking system also includes a keyhole for a complementary key which can be used to manually unlock the device. Once the locking system is unlocked by the button, it cannot be unlocked again until the key is used at which point the locking system is reset such that the button can be actuated, and the locking system can be unlocked one time.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
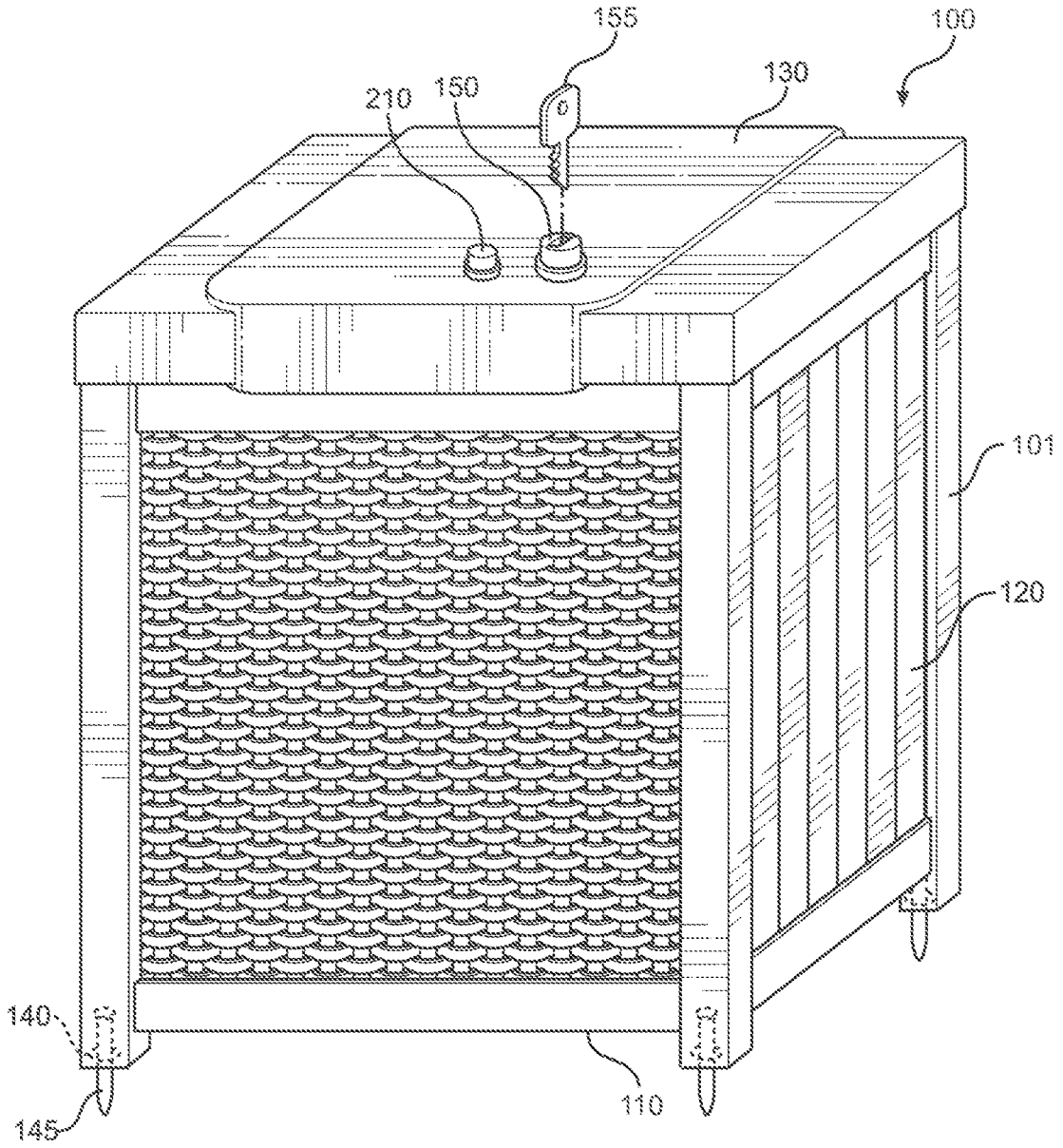
FIG. 1 shows a perspective view of an embodiment of the automatically locking delivery box, in a closed configuration.

Reference is made herein to the attached drawings. Like reference numerals are used throughout the drawings to depict like or similar elements of the automatically locking delivery box. For the purposes of presenting a brief and clear description of the present invention, a preferred embodiment will be discussed as used for the automatically locking delivery box. The figures are intended for representative purposes only and should not be considered to be limiting in any respect.

Referring now to FIG. 1, there is shown a perspective view of an embodiment of the automatically locking delivery box, in a closed configuration. In some embodiments, the automatically locking delivery box 100 comprises a housing 101 formed by a base 110, at least one sidewall 120, and a lid 130. In some embodiments, the automatically locking delivery box 100 comprises a base 110 with at least one sidewall 120 rising therefrom and a locking system. In some embodiments, the sidewall 120 is disposed about a perimeter of the base 110. In the shown embodiment, the side walls 120 are perpendicular to the base 110 to form a box. In other embodiments, the sidewalls 120 can be disposed at an acute or an obtuse angle relative to the base 110, and can comprise curves, in order to provide a desired shape and structure to the device.

A lid 130 is disposed at a top portion of the sidewalls 120. The base 110, sidewall 120, and lid 130 define an interior volume of the device. In the shown embodiment, the lid 130 is hingedly attached to the sidewall 120. Further, the hinge is disposed on a lower surface of the lid 130, such that when the lid 130 is down and in contact with the sidewall 120 in a closed configuration, the hinge is in the internal volume of the device. In this manner, the hinge is protected from an authorized person attempting to gain access to the interior volume. In various embodiments, external surfaces of the device are decorated with designs to provide a desired aesthetic. For example, in one embodiment, an exterior surface of the sidewalls 120 and lid are camouflaged.

In some embodiments, the base 110 can be securely fastened to a desired surface such that an unauthorized individual cannot pick up the device and move it, or steal it, in order to gain access to the interior volume. In one such embodiment, the base further comprises at least one aperture 140. The aperture 140 can be utilized to pass a securing fastener 145 therethrough, such as a bolt. In a further embodiment, the device includes a securement fastener 145 which is sized and shaped to utilize the aperture 140 to secure the base 110 to a desired surface. In the shown embodiment, a plurality of legs is disposed equidistantly at the four corners of the base 110. Further, in the shown embodiment, the legs each include an aperture 140. The legs enable a bottom surface of the base 110 to be elevated above a ground surface such that the base 110 is not touching the ground. In such a manner, dirt, mud, water, and other undesirable elements can be separated from the bottom surface of the base 110.

In some embodiments, the locking system is paired to a unique key 155. The unique key 155 can be a physical key. In some embodiments, the locking system further comprises a keyhole 150. The keyhole 150 is sized and shaped to receive a complementary key 155. In one embodiment, the complementary key 155 is a unique key 155 specifically paired to the keyhole 150 of the device. In this manner, each individual device can have its own unique key 155 such that the key 155 cannot be used in any other device including other automatically locking delivery boxes 100. The key 155 is utilized in the keyhole 150 to manually unlock the locking system. In the shown embodiment, the keyhole 150 is disposed on an exterior surface of the lid 130. However, in other embodiments, the keyhole 150 can be disposed on any exterior surface of the device in order to provide easier access and a desired aesthetic.

Figure 2:
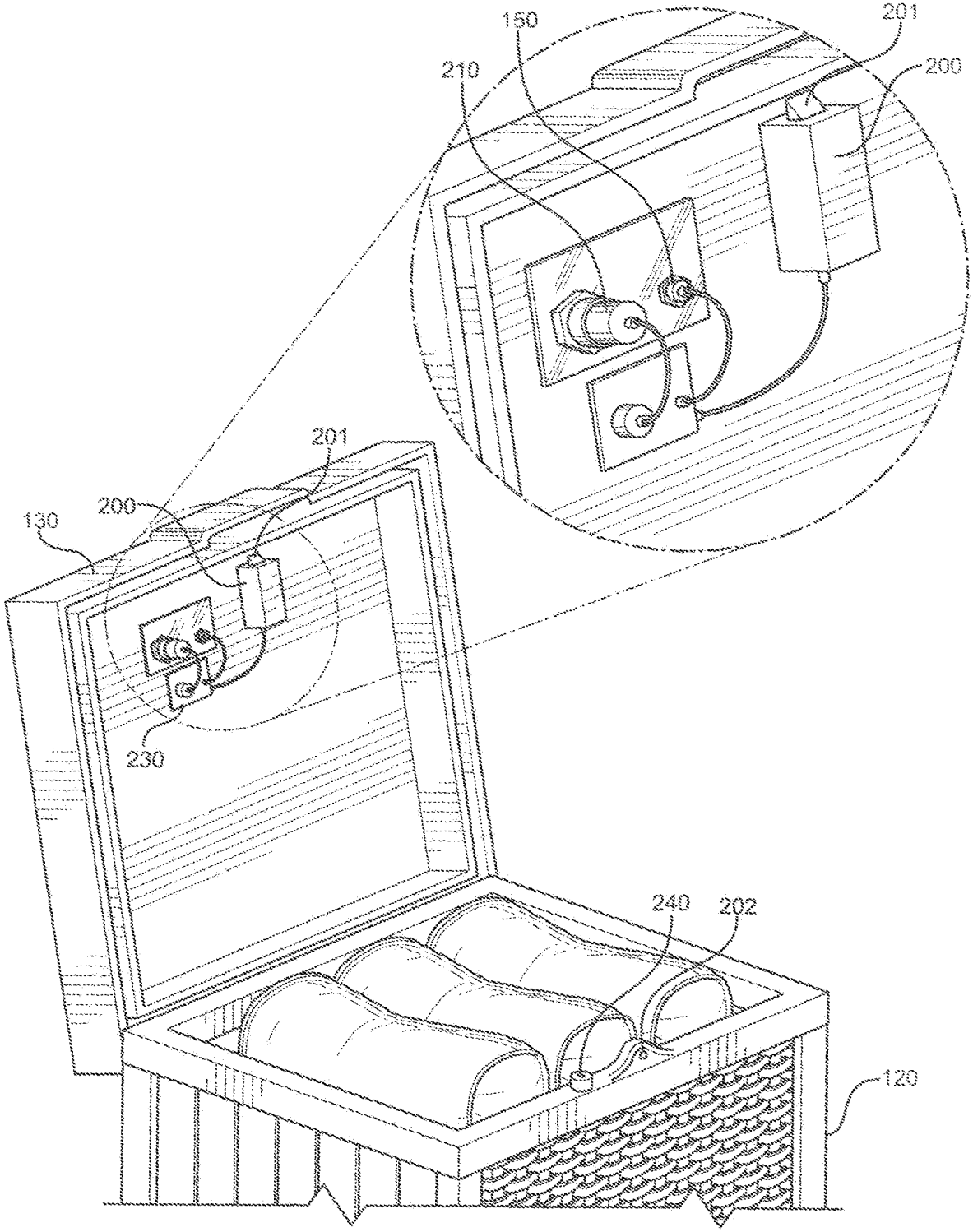
FIG. 2 shows a perspective view of an embodiment of the automatically locking delivery box, in an open configuration.

Referring now to FIG. 2, there is shown a perspective view of an embodiment of the automatically locking delivery box, in an open configuration. The locking system 200 is in operable connection to the lid 130 and the sidewalls 120. The locking system 200 is configured to secure and lock the lid 130 to the sidewall 120 in a locked configuration, and to unlock and release the lid 130 from the sidewall in an unlocked configuration. In the shown embodiment, the locking system 200 comprises a latch 201 and a reciprocal recess 202 in the sidewall 120 such that when the latch 201 is extended, the latch 201 is received by the reciprocal recess 202 in the sidewall 120 in the locked configuration. In some embodiments, the locking system 200 is electric and is powered by a rechargeable power source. Similar to the hinge, in some embodiments, the locking system 200 is protected within the interior volume of the housing in order to protect against an authorized person attempting to gain access to the interior volume.

The locking system 200 is in operable communication with a button 210. In the embodiment shown in FIG. 1, the button 210 is disposed on an exterior surface of the lid 130. However, alternate locations of the button 210 are contemplated by the present disclosure and it is contemplated that the button 210 can be disposed on any exterior surface of the device. In some embodiments, the locking system 200 is configured to unlock one time when the button 210 is actuated. In such embodiments, the button 210 can only unlock the locking system 200 one time, or until the locking system 200 is reset by utilization of the key. Thus, whereupon the key is utilized, such as in the keyhole 150, the locking system 200 is reset such that the button 210 can be actuated, and the locking system 200 can be unlocked one time again. In some embodiments, the locking system 200 further comprises a counting device such that a count can be maintained on whether or not the locking system 200 has been opened by the button 210. Where the button 210 is utilized to unlock the locking system 200, the count is incremented. Where the count is non-zero, actuation of the button 210 will not result in the locking system 200 unlocking. Where the key is utilized, the count is reset to zero.

The locking system 200 is configured to detect when the lid 130 is opened and to lock once the lid 130 is closed again. In some embodiments, the locking system 200 can detect the position of the lid 130 via a sensor 240, wherein the sensor 240 is in operable communication with the locking system 200. In some embodiments, the sensor 240 is configured to detect when the lid 130 is opened. In the shown embodiment, the sensor 240 is disposed on a top surface of the sidewall 120. When the lid 130 is down and pressed against the top surface of the sidewall 120, the sensor 240 determines the lid 130 is closed. In some embodiments, the sensor 240 is a light sensor, while in other embodiments, the sensor 240 is a motion sensor. One of ordinary skill in the art will understand how a sensor 240 can determine the position of the lid and the present disclosure is not limited to a specific type of sensor, and all types of sensors that can determine the position of the lid 130 relative to the sidewall 120 are contemplated.

In some embodiments, the locking system 200 is in operable communication with a control circuit 230. In some embodiments, the control circuit is powered by a power source (as shown in FIG. 3B, 310) such as a rechargeable battery. The control circuit 230, in turn, is paired with the button 210. In such embodiments, the control circuit 230 is configured to determine when the button 210 is actuated, when the key is inserted into the locking system 200, when the lid 130 is open, and when the lid 130 is returned to a closed configuration. In some embodiments, the sensor 240 is in operable communication with the control circuit 230 and the sensor 240 is configured to detect when the lid 130 is opened. In one embodiment, the sensor 240 is in wireless communication with the control circuit 230. The control circuit 230 is configured to engage the locking system 200 to secure and lock the lid 130 to the sidewall 120 after the button 210 is actuated, the lid 130 is opened, and the lid 130 is returned to a closed configuration. The control circuit 230 is further configured to keep the locking system 200 engaged, in a locked configuration, to secure and lock the lid 130 to the sidewall 120 after the lid 130 is returned to the closed configuration, even when the button 210 is further actuated, until the key is utilized to unlock the locking system 200. The control circuit 230 is also configured to reset the locking system 200 after the key is utilized to unlock the locking system 200 such that the button 210 can be actuated one time to unlock the locking system 200.

Figure 3A:
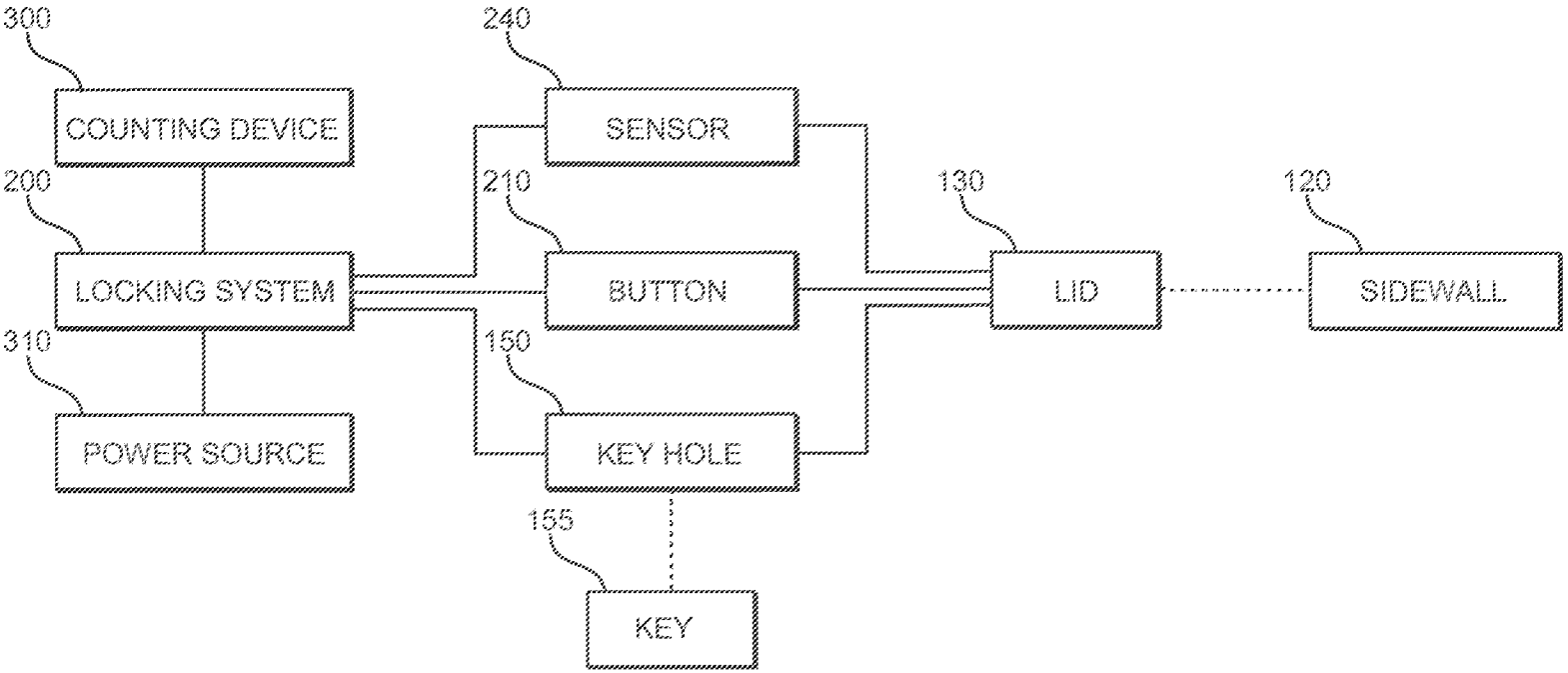
FIG. 3A shows a chart of representative components in an embodiment of the automatically locking delivery box.
Figure 3B:
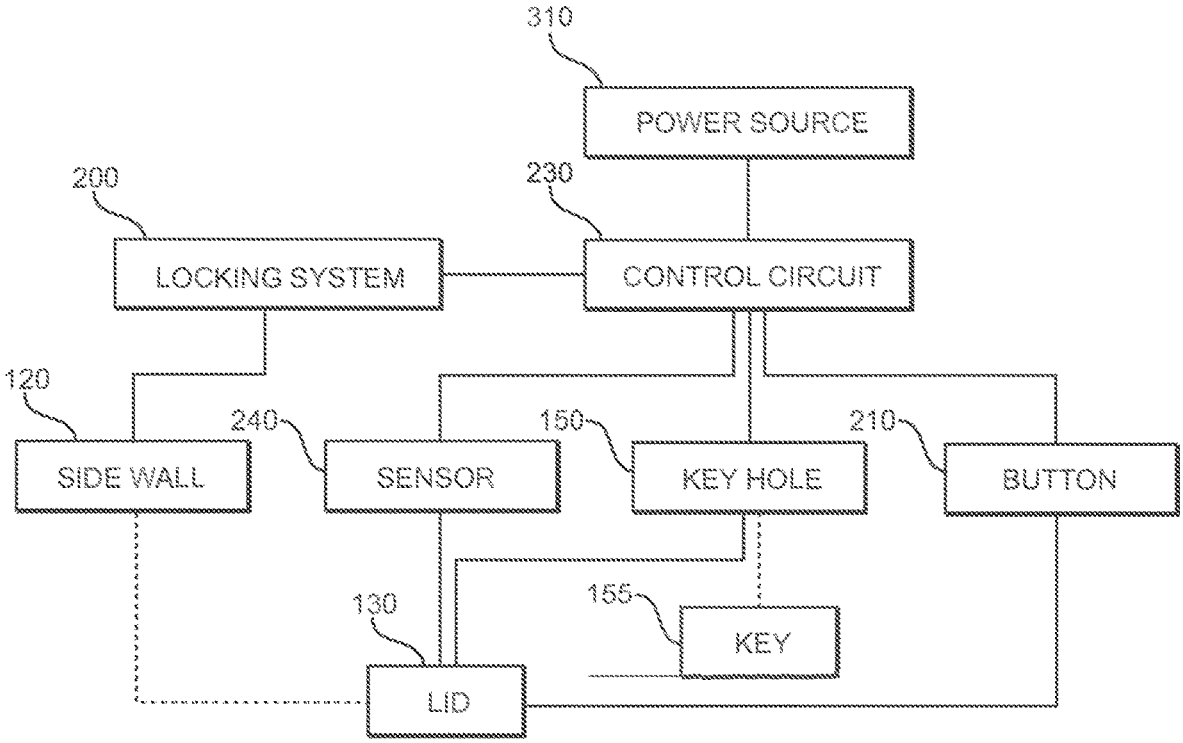
FIG. 3B shows a chart of representative components in an alternate embodiment of the automatically locking delivery box.

Referring now to FIG. 3A, there is shown a chart of representative components in an embodiment of the automatically locking delivery box. In the shown embodiment, the locking system 200 is operably connected to a counting device 300 and a power source 310. The power source 310 provides electricity to the locking system 200 and can include a variety of sources of electricity such as a battery, a rechargeable battery, and an electric cord attached to an electric outlet. The counting device 300 is configured to detect and store a count of a number of times that a button 210 is pressed and a number of times the locking system 200 is unlocked by pressing said button 210. The locking system 200 is in communication with a sensor 240, the button 210, and a keyhole 150, wherein the keyhole is uniquely paired with a key 155. In this manner, the sensor 240 can detect the position of a lid 130 relative to a sidewall 120, in order to determine if the lid 130 has been opened or closed. In one embodiment, the button 210, the keyhole 150, and the sensor 240 are disposed on an exterior surface of the lid 130. As detailed above, the button 210 can be actuated, and can unlock the locking system 200 one time. Once the button 210 has unlocked the locking system 200, further actuations of the button 210 will not unlock the locking system 200 until the key 155 is utilized in the keyhole 150. In this manner, a delivery person can actuate the button 210 when they arrive at a package recipient's house to gain access to the interior of the device. The package and mail can be left in the interior volume, and when the lid 130 is closed, the device will automatically lock. Further actuations of the button 210 will not result in unlocking the device, thereby keeping the package and/or mail secure until the owner unlocks the device via the key 155. Such usage of the key 155 will also reset the device such that the device is prepared for the next delivery and actuation of the button 210 can unlock the locking system 200 at the next delivery.

Referring now to FIG. 3B, there is shown a chart of representative components in an alternate embodiment of the automatically locking delivery box. In the shown embodiment, the locking device 200 is in operable communication with a control circuit 230. The control circuit 230 is powered by the power source 310. The control circuit 230 is paired to the button 210 and is in operable communication with the keyhole 150 and the sensor 240. In one embodiment, the keyhole 150, the button 210, and the sensor 240 are disposed on an external surface of the lid 130. The control circuit 230 is configured to determine when the button 210 is actuated, when the key 155 is inserted into the locking system 200, when the lid 130 is open, and when the lid 130 is returned to a closed configuration. The control circuit 230 is configured to engage the locking system 200 to secure and lock the lid 130 to the at least one sidewall 120 after the button 210 is actuated, the lid 130 is opened, and the lid 130 returned to a closed configuration. The control circuit 230 is further configured to keep the locking system 200 engaged to secure and lock the lid 130 to the at least one sidewall 120 after the lid 130 is returned to the closed configuration, even when the button 210 is further actuated, until the key 155 is utilized to unlock the locking system 200. The control circuit 230 is also configured to reset the locking system 200 after the key 155 is utilized to unlock the locking system 200 such that the button 210 can be actuated, one time, to unlock the locking system 200.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automatically locking delivery box, comprising:

a housing formed by a base, at least one sidewall, and a lid;

wherein the at least one sidewall is disposed about a perimeter of the base;

wherein the lid is hingedly attached to the at least one sidewall;

a locking system in operable connection to the lid and the at least one sidewall;

wherein the locking system is configured to secure and lock the lid to the at least one sidewall in a locked configuration, and to unlock and release the lid from the at least one sidewall in an unlocked configuration;

the locking system paired to a unique key;

the locking system in operable communication with a control circuit;

the control circuit paired to a button;

the control circuit configured to determine when the button is actuated, when the key is inserted into a keyhole of the locking system, when the lid is open, and when the lid is returned to a closed configuration;

the control circuit configured to engage the locking system to secure and lock the lid to the at least one sidewall after the button is actuated, the lid is opened, and the lid returned to the closed configuration;

the control circuit configured to keep the locking system engaged to secure and lock the lid to the at least one sidewall after the lid is returned to the closed configuration, even when the button is further actuated, until the key is utilized to unlock the locking system; and the control circuit configured to reset the locking system after the key is utilized to unlock the locking system such that the button is actuated one time to unlock the locking system.

2. The automatically locking delivery box of claim 1, wherein the control circuit is powered by a rechargeable power source.

3. The automatically locking delivery box of claim 1, wherein an exterior surface of the at least one sidewall and lid are camouflaged.

4. The automatically locking delivery box of claim 1, wherein the base further comprises at least one aperture.

5. The automatically locking delivery box of claim 4, further comprising a securement fastener sized and shaped to utilize the aperture to secure the base to a desired surface.

6. The automatically locking delivery box of claim 1, wherein the button and the keyhole are disposed on an exterior surface of the lid.

7. The automatically locking delivery box of claim 1, wherein the at least one sidewall is perpendicular to the base.

8. The automatically locking delivery box of claim 1, wherein the locking system is protected within an interior volume of the automatically locking delivery box.

9. The automatically locking delivery box of claim 1, further comprising a sensor, wherein the sensor is configured to detect when the lid is opened, and the sensor is in operable communication with the control circuit.

* * * * *